United States Patent [19]

LeBow

[11] Patent Number: 4,965,974

[45] Date of Patent: Oct. 30, 1990

[54] STEEL UTILITY STRUCTURE AND METHOD FOR ASSEMBLY THEREOF

[76] Inventor: Dwight R. LeBow, 465 Southern Oaks Dr., Lake Jackson, Tex. 77566

[21] Appl. No.: 436,351

[22] Filed: Nov. 14, 1989

[51] Int. Cl.[5] ..... E04H 12/00

[52] U.S. Cl. ..... 52/301; 52/637; 52/648; 52/741

[58] Field of Search ..... 52/637, 648, 236.7, 52/726, 299, 301, 251, 650, 741; 403/174, 178, 167, 335, 336, 337

[56] References Cited

U.S. PATENT DOCUMENTS

| | | | |
|---|---|---|---|
| 2,046,152 | 6/1936 | Dean | 52/301 |
| 3,378,971 | 4/1968 | Singer et al. | 52/236.7 |
| 3,788,024 | 1/1974 | De Hartoy | 52/648 |
| 3,942,297 | 3/1976 | Kitagawa | 52/637 |
| 4,330,970 | 5/1982 | Bonintz | 52/236.7 X |

*Primary Examiner*—Carl D. Friedman
*Attorney, Agent, or Firm*—Browning, Bushman, Anderson & Brookhart

[57] ABSTRACT

A modular steel utility structure and a method of assembly is disclosed. The construction employs a plurality of vertical steel columns and horizontal frames. Each column has capital and basal steel erection plates secured at respective upper and lower ends. The capital plate has from one to four pins extending upwardly therefrom and laterally off-set from the column. Each basal plate has a corresponding number of apertures similarly spaced from the column. Each frame has a top and bottom erection plate secured at each corner thereof. The bottom erection plate has an aperture spaced from the frame members for receiving the pin from a capital plate of a column immediately therebeneath for registration therewith. The top erection plate has an upwardly projecting pin which is received in register by the aperture on a basal plate of a column in the story or level immediately above it. In this manner, the structure is assembled by positioning a story or level of columns with a crane, and then by placing the prefabricated frames in position to be supported by the columns. Additional stories are added by successively positioning tiers of columns and frames. The adjacent erection plates on the columns and frames may be bolted together or otherwise secured for additional stability.

19 Claims, 8 Drawing Sheets

STEEL UTILITY STRUCTURE AND METHOD FOR ASSEMBLY THEREOF

FIELD OF THE INVENTION

The present invention relates to the art of structural steel construction or erection, and particularly to the modular construction of structural steel used in various industries, such as, for example, oil or petrochemical plants.

BACKGROUND ART

Towers and other structures made from structural steel are commonly used in various industries, such as, for example, refineries, petrochemical plants, and the like. The fabrication of such structures from structural steel is complicated by the use of personnel fall restraint devices which are increasingly popular with a general desire for improved personnel safety. Steel-workers at elevations substantially above ground employ safety belts, harnesses and the like which are awkward to use, particularly when the worker must traverse a joint or other obstruction which prevents passage of the restraint device attachment. In addition, as the structural steel structure is erected, there are initially at least no handrails positioned for the safety of the worker.

The prior art steel structures are generally erected by welding and/or bolting various structural members such as columns and crossbeams together. Diagonal and knee bracing is generally required to adequately strengthen the structure. Considerable effort is also involved in accurate placement and leveling of the structure. In addition, when it is desired to demolish the conventional structural steel structures, it is necessary to unbolt and cut the structural steel members. Moreover, such demolition can be dangerous and expensive.

Concrete structures have sometimes been employed, but these are rarely encountered in the petrochemical industry. Steel structures are generally chosen because they are relatively inexpensive to fabricate and erect, and are more readily modified after installation when the need arises. Nonetheless, various modular concrete constructions, which generally employ concrete slabs as opposed to structural steel members, are known and used, especially in the high rise building industry. Examples of this art are found in U.S. Pat. Nos. 4,330,970 to Bonink; 3,827,203 to Berrie; 3,378,931 to Singer et al.; 3,429,092 to Perry et al.; and 4,640,070 to Moffat.

Bonink discloses a design utilizing single column members equipped with up to four vertical pipes which function as dowels to interlock with framing beams. However, this design is intended to provide some degree of dimensional flexibility for the concrete structures. Thus, this construction requires grouting in the voids of the framing beams in which the pipes or dowels are received. This would also appear to complicate disassembly of the structure.

Use of the Berrie construction design is not readily adaptable to structural steel erection. This design requires complicated beam-to-column connections which would make preassembly and erection of floor sections in structural steel structures difficult at best.

From U.S. Pat. No. 3,378,971 to Singer et al., it is known to use a joint member in a floor or roof member of a building wherein the roof or floor is a slab and the joint is a tapered spigot and socket joint to effect a rigid distortion-resistant connection between the slab and the column. The spigot is coaxial with each column and requires a column for each corner of a floor panel. Structural strength in this design is achieved with a tight fit between the spigot and corresponding socket formed in the floor panel.

From U.S. Pat. No. 3,429,092 to Perry et al., it is known to use preformed concrete columns and beams by using axially extending connector spindles and radially extending collar means to support and connect succeeding column tiers.

From U.S. Pat. No. 4,640,070 to Moffat it is known to use support columns which are brought through the existing roof of a building in combination with a large platform truss supported thereon to support conventional construction built on the platform truss to add extra floors on existing buildings.

Modular construction has also been used in toy and model building sets, such as, for example, as described in U.S. Pat. Nos. 2,676,420 to Berg and 4,571,200 to Serna. Berg describes a model building construction comprising floor mat members which are perforated at the corners thereof and column members comprising, at one end a horizontal plate having a dowel member adapted to anchor to the floor member and a superimposed column member, and at the other end a flat plate member having an aperture adapted to receive the dowel member from the column therebelow. While this technique appears to work well with toy models, such a construction would not be structurally possible in full scale structural steel construction because it requires sandwich decking between column sections. Similar structures in steel construction such as steel grating or fiberglass reinforced plastic grating, would fail under such circumstances. The Serna reference has similar drawbacks.

SUMMARY OF THE INVENTION

The present invention provides a modular construction system and method for erecting steel structural platforms and towers which eliminates and/or avoids problems associated with the above-described prior art.

In one aspect, the invention provides a modular steel utility structure which has a plurality of vertical steel columns and at least one horizontal steel frame. Each column has capital and basal steel erection plates secured at respective upper and lower ends thereof. The capital erection plate has at least one alignment pin extending upwardly therefrom. The pin is laterally spaced or offset from the column. The basal plate has at least one vertical aperture also spaced laterally from the column. The steel frame comprises structural steel beams. Top and bottom erection plates are affixed on the beams. The bottom erection plate has an aperture spaced from the beams for receiving, in registration, the pin from a capital erection plate of a column immediately therebeneath to align the frame for support by said column. The top erection plate has an upwardly projecting alignment pin which is received in registry by the aperture in a basal plate in a column immediately thereabove to align the column so that the column above the frame is aligned with the column beneath the frame.

The structure may be constructed with a plurality of first level steel columns, each of which has a base secured to a foundation and a capital erection plate with at least one pin extending upwardly into the aperture of one of the bottom erection plates of a frame supported on the first level column.

Each level of columns may include corner columns which support only one corner of one frame at an outside corner of the structure. Depending on the number of frames, the structure may also include edge columns supporting two adjacent frames along an outside edge of a structure, and interior columns which support a multiplicity of frames which have corners positioned circumferentially all the way around the column. The capital erection plate of the edge columns has a pair of pins on opposite sides of the columns, each pin being received in an aperture in a bottom erection plate of each respective frame. Similarly, the capital erection plate of the interior columns has a multiplicity of pins for engagement in each aperture of each frame the corner of which is supported by the interior column. The frames are suitably rectangular in plan, but other shapes, such as triangles, hexagons, and the like may also be used. In this manner, the modular structure can be constructed to have virtually any desired number of levels or stories.

The apertures in the erection plates may be provided with frustoconical side walls which taper down in transverse dimension from the bottom end to the top end to facilitate reception of the alignment pins therein. Similarly, the pins may have a relatively large transverse dimension adjacent the erection plate from which it projects and a relatively small transverse dimension away from the plate to facilitate insertion of the pins in the apertures. If desired, the frames and columns may be bolted together by bolting together the opposing pairs of capital and bottom erection plates at the bottom of each level, and the top and basal erection plates at the top of each level.

The erection plates serve to facilitate assembly and disassembly of the modular structural steel construction. The plates also serve to strengthen the structure enough to eliminate the necessity for any, or at least most, diagonal and knee bracing. The modular construction facilitates completion of one level or story at a time with prefabricated frames and columns with the aid of conventional hoisting equipment and minimizes the time necessary for workers to be at an elevation while assembling the structure. In addition, by providing the frames with prefabricated flooring and/or handrails, the workers can function almost immediately in relative safety. In addition, caged ladders may be affixed directly to lower level columns to facilitate immediate access to upper levels.

In another aspect, the invention provides a method of modularly assembling a steel utility structure. The method includes the steps of mounting a plurality of prefabricated, horizontally spaced lower level steel columns, mounting an upper level steel frame supported by the lower level columns, mounting a plurality of prefabricated steel upper level columns on the upper level frames, repeating the frame mounting and column mounting steps to the desired number of levels, and mounting a terminal level of the frames on the uppermost columnar level. The first level columns have a capital erection plate with an upwardly projecting alignment pin which is laterally spaced from the column. The capital erection plates are at a uniform elevation and a lower end of each column is fixedly supported, e.g., by bolting to a foundation. The next upper level steel frame is mounted with its corners supported by the lower level columns. The frames are prefabricated and have top and bottom erection plates at each supported corner. Each bottom erection plate has an aperture for receiving the respective lower column capital erection plate pin. Each top erection plate of the frame is secured opposite the bottom plate and has an upwardly projecting alignment pin laterally spaced from the respective lower level column. The columns in the second and higher levels have both basal and capital steel erection plates at opposite ends thereof. The basal erection plate has an aperture spaced from the column for receiving the top erection plate pin from the frame immediately beneath it. The capital plate has an upwardly projecting pin laterally spaced from the column, and each capital plate in each columnar level is at uniform elevation. The terminal level steel frame is provided with a similar bottom erection plate with an aperture formed therein for receiving the capital erection plate pin of the column beneath it.

The method also preferably includes the steps of bolting each of the basal erection plates to an adjacent top erection plate of the frame below the column, and bolting each columnar capital erection plate to an adjacent bottom erection plate of the frame above the column. The method may also include mounting the frames by attaching a plurality of lugs to the top erection plates of the frames, and using hoisting cables attached to the lugs to maneuver the frames into position for mounting. Once the frame is in position on its supporting columns, the cables and lugs may be removed from the top erection plates so that they do not interfere with the subsequent mounting of an additional level of columnar members thereon.

DETAILED DESCRIPTION OF THE PREFERRED EMBODIMENTS

Figure 1:
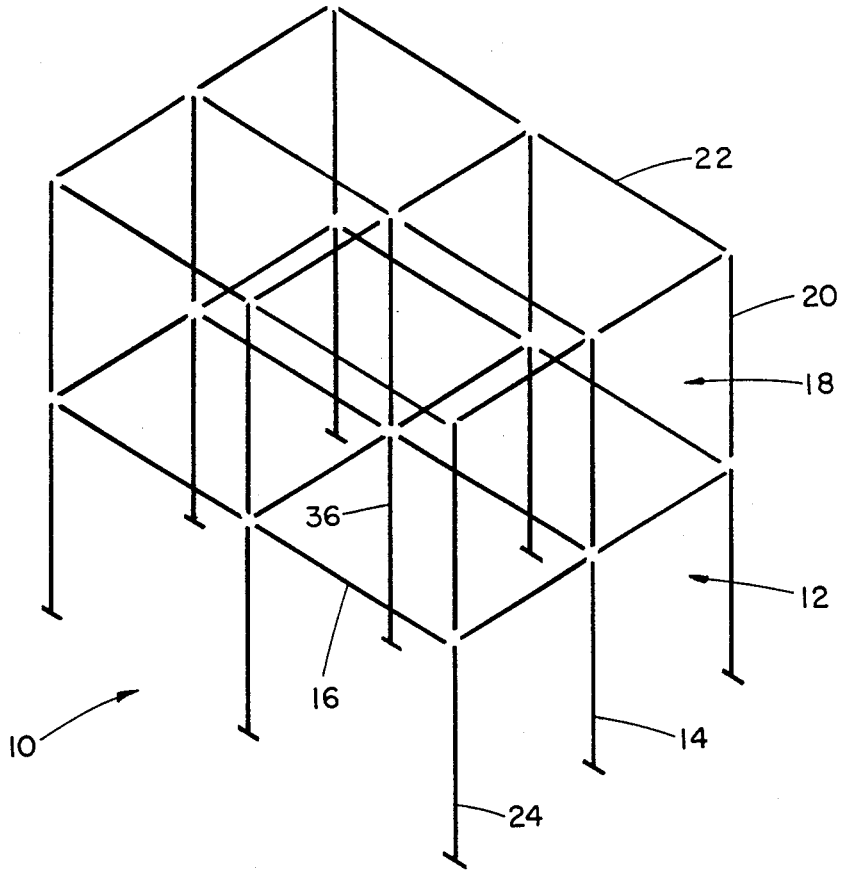
FIG. 1 is a schematic isometric view of a two-level, four-frame rectangular structural steel platform according to the present invention.

With reference to the drawings wherein like reference numerals are used to indicate like parts, FIG. 1 illustrates in isometric, schematic form a two-level platform 10 erected according to the present invention. The platform 10 has a first level 12 including columnar members 14 which extend from a foundation (not shown) to frame members 16 which are the ceiling of the first level 12 and the floor of a second level 18. The second level 18 includes columnar members 20 which extend from the frame members 16. The frame members 22 at the top of the platform 10 are supported by the columnar members 20. All of the frame members 22 and columnar members 20 are constructed of structural steel such as, for example, girders, beams or the like. I-beams are referred to herein as an exemplary preferred structural steel member for use in the present invention, with the understanding that other structural steel members may likewise be used.

Figure 2:
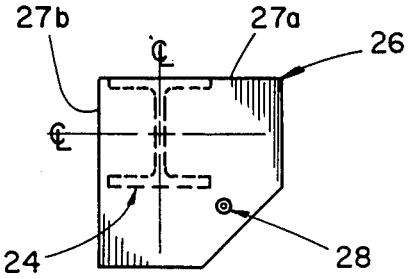
FIG. 2 is a plan view of a capital erection plate of a corner column in the platform of FIG. 1 according to the present invention.
Figure 3:
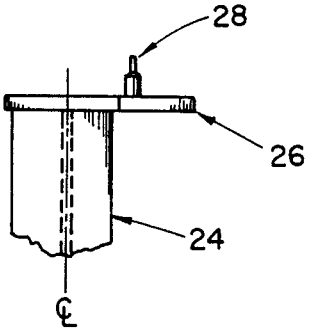
FIG. 3 is an elevation of the corner column-capital erection plate arrangement of FIG. 2.
Figure 8:
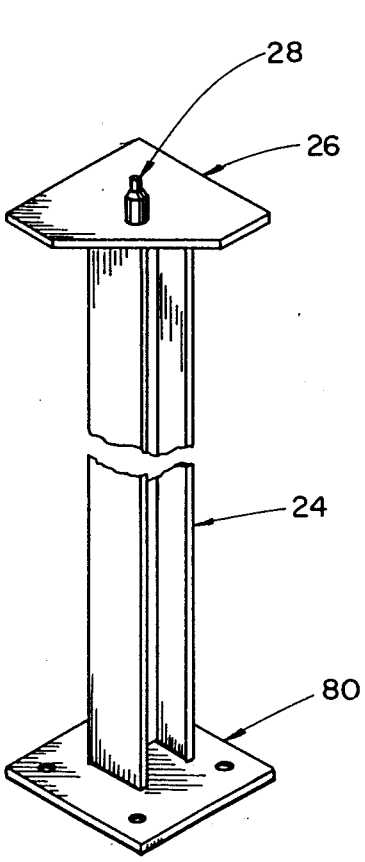
FIG. 8 is a perspective view of a first-level corner column in the platform of FIG. 1 according to the present invention.
Figure 6:
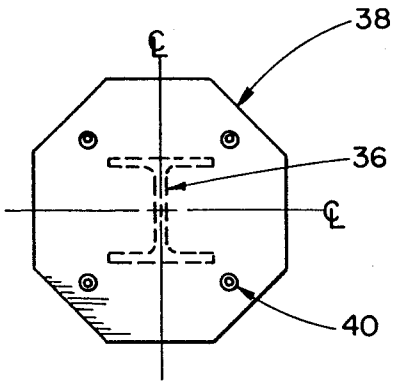
FIG. 6 is a plan view of a capital erection plate for an interior column in the platform of FIG. 1 according to the present invention.
Figure 7:
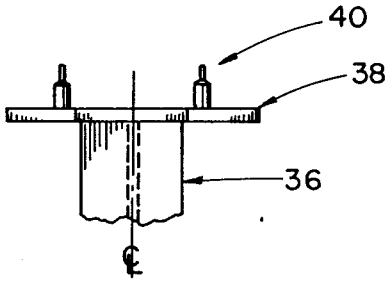
FIG. 7 is an elevation view of the interior column-capital erection plate arrangement of FIG. 6.

In FIGS. 2 and 3, columnar member 24 is illustrated as a corner column having a capital erection plate 26 welded or otherwise affixed thereto. The capital erection plate 26 is welded to a top end of the columnar member 24. The edge 27*a* of the capital erection plate 26 is welded adjacent one flange of the column 24, and a transverse edge 27*b* is disposed adjacent the ends of each of the flanges of the column 26 so that the entire end surface of the column 24 abuts the capital plate 26 for maximum welding area and strength. The plate 26 extends laterally opposite the corner formed by the edges 27*a* and 27*b* into a quadrant defined by the web and flange centerlines of the column 24. A vertical alignment pin 28 is welded or otherwise secured so that it projects upwardly from the capital erection plate 26 laterally offset from the column member 24, preferably equally spaced from the web center line and the flange center line so as to bisect the angle of their intersection. Capital plate 26 is fabricated from steel plate of suitable quality and thickness to support one corner of a frame 16 thereon, and especially to form a heavy moment connection therewith.

Figure 4:
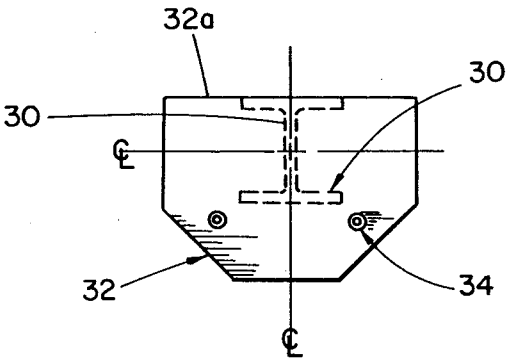
FIG. 4 is a plan view of a capital erection plate for an edge column in the platform of FIG. 1 according to the present invention.
Figure 5:
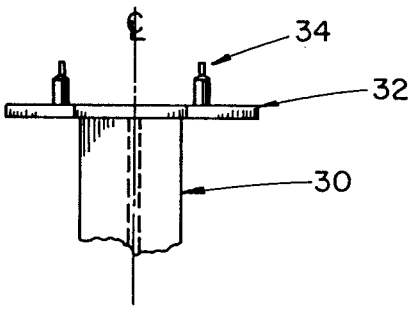
FIG. 5 is an elevation view of the edge column-capital erection plate arrangement of FIG. 4.
Figure 13:
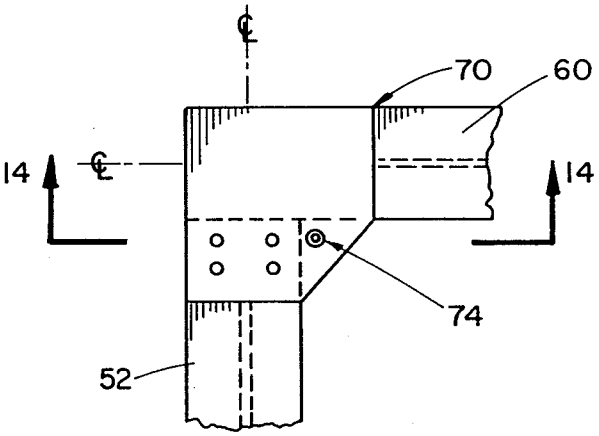
FIG. 13 is a plan view of a corner of the frame of FIG. 12.
Figure 14:
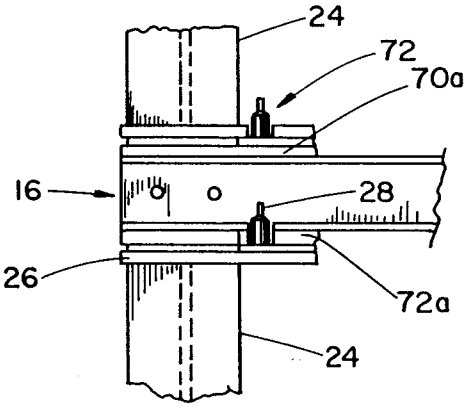
FIG. 14 is an elevation view of the frame member corner of FIG. 13 as seen along the lines 14—14 and positioned between corner columnar members according to the present invention.
Figure 10:
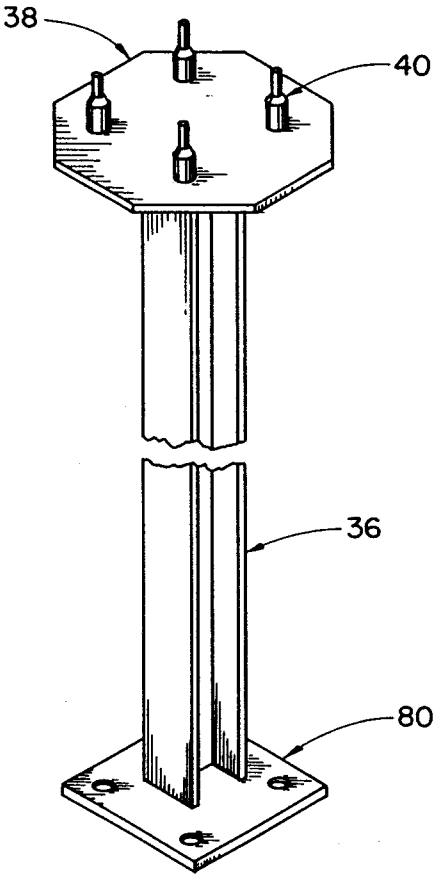
FIG. 10 is a perspective view of a first-level interior column in the platform of FIG. 1 according to the present invention.
Figure 9:
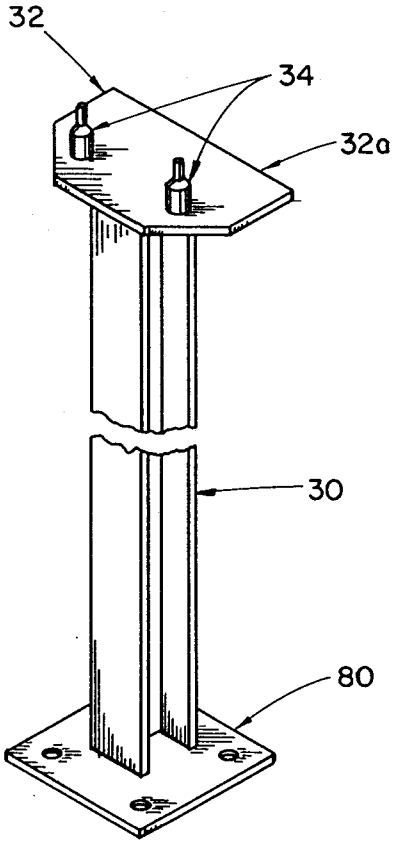
FIG. 9 is a perspective view of a first-level edge column in the platform of FIG. 1 according to the present invention.

As best seen in FIGS. 4 and 5 the edge columns 30 which support adjacent frame members along an outer edge of the platform 10 are provided with a capital erection plate 32 which is similar to the plate 26, but extends into two quadrants and has a pair of upwardly projecting pins 34 thereon supporting each adjacent frame structure. The plate 32 is generally symmetrical about the flange centerline of the column 30, and has an edge 32*a* adjacent a flange of the column 30.

If desired, however, the plate 32 could be symmetrically positioned about the web center line with the edge 32*a* adjacent the ends of the flanges, i.e., with the column 30 rotated 90° from the position shown in FIGS. 4 and 5.

Similarly, the interior column 36 is provided with a capital erection plate 38 extending into all four quadrants from which four pins 40 upwardly project for positioning and supporting four frame members which are circumferentially spaced around the column member 36. The plate 36 is generally symmetrical about both the flange centerline and the web centerline of the column 36.

Figure 11:
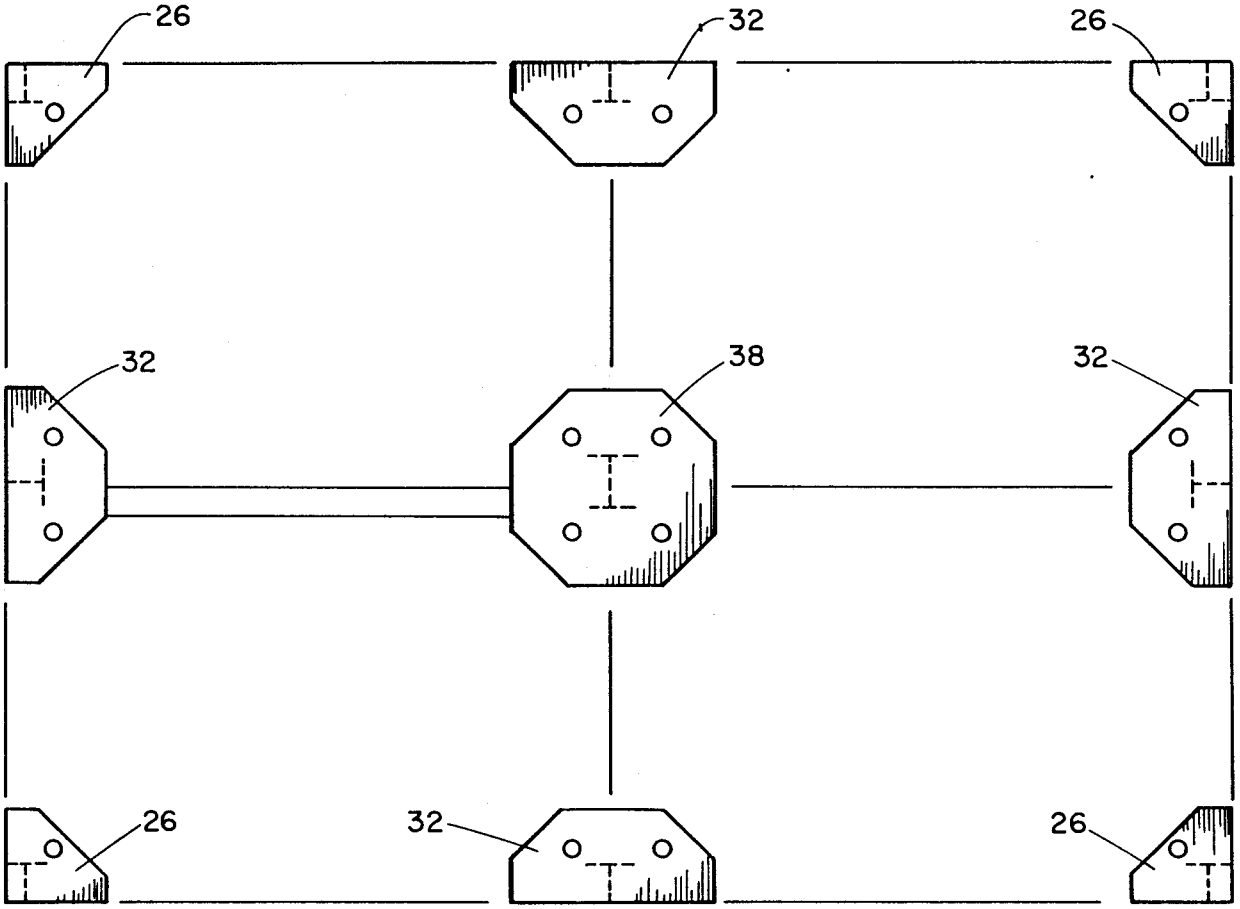
FIG. 11 is a plan view of the capital erection plates of the platform of FIG. 1 according to the present invention.

To support a structure having four frame members on each level, the columns in the first level are arranged according to the plan as seen in FIG. 11. Four corner column erection plates 26 are positioned in each corner of the rectangular pattern. Four edge column erection plates 32 are similarly positioned on an edge of the rectangular shape between each of the plates 26. The interior column capital erection plate 38 is placed in the geometrical center of the rectangular pattern.

Figure 12:
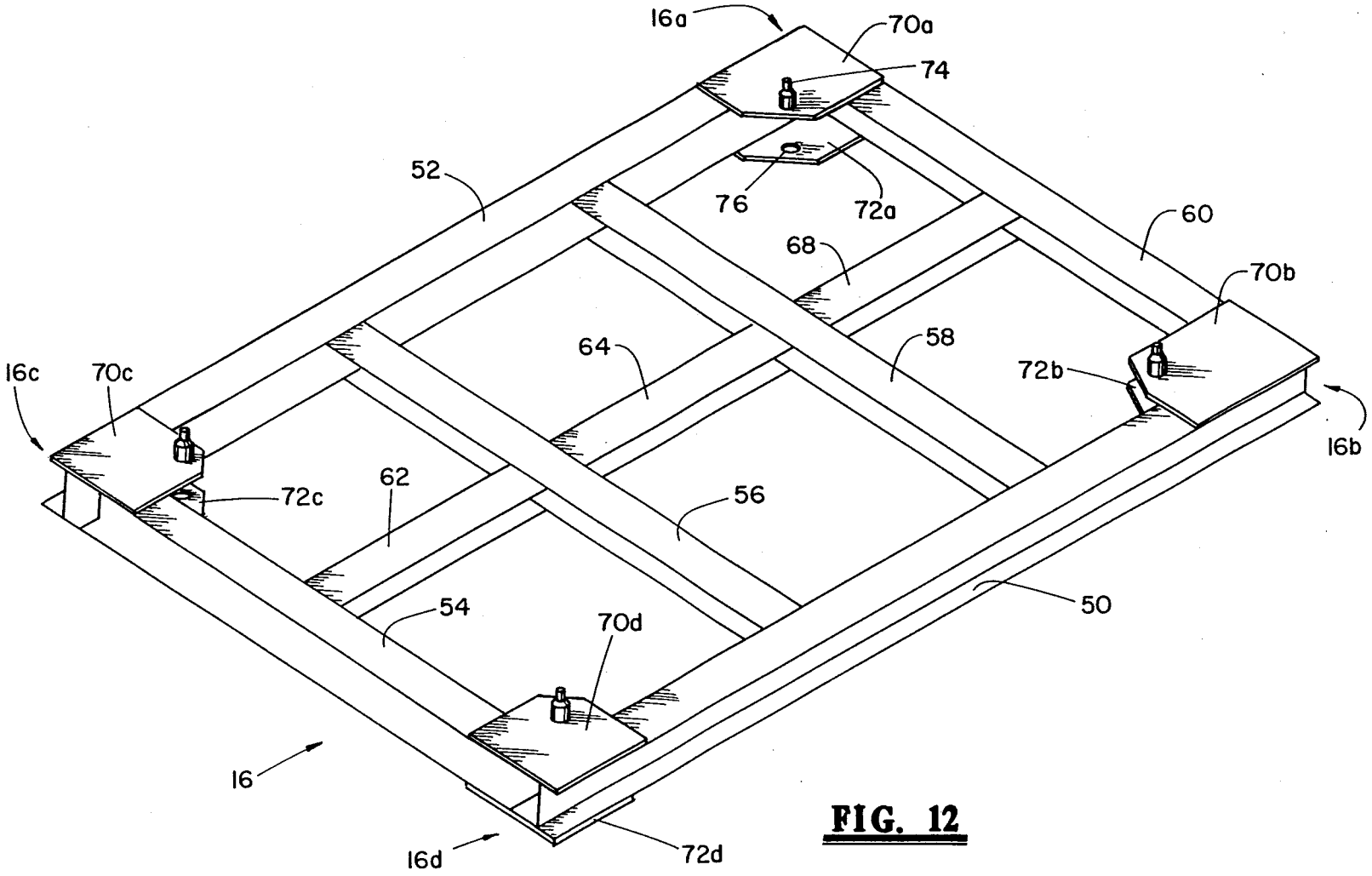
FIG. 12 is a perspective view of a frame of the platform structure of FIG. 1 according to the present invention.

In FIG. 12, the frame 16 includes opposed longitudinal side members 50 and 52 constructed of suitable structural steel. A plurality of transverse members, 54, 56, 58, and 60 are evenly spaced and connect at opposite ends to the longitudinal members 50 and 52 in a conventional manner, e.g., bolting or welding. The lateral members 62, 64, and 68 are disposed longitudinally between the longitudinal members 50 and 52, and connect the transverse members 54, 56, 58 and 60 for additional structural rigidity. The number and arrangement of the frame members is dictated by the structural and design requirements.

At each corner 16*a*, 16*b*, 16*c* and 16*d* of the frame 16 there is securely affixed, e.g., by welding or bolting, respective top erection plates 70*a*, 70*b*, 70*c* and 70*d* and a bottom erection plates 72*a*, 72*b*, 72*c* and 72*d*. Each erection plate 70*a*, 70*b*, 70*c*, 70*d*, 72*a*, 72*b*, 72*c* and 72*d* extends into a quadrant containing the frame 16. The top erection plates 70*a*, 70*b*, 70*c*, and 70*d* each have an alignment pin 74 projecting upwardly therefrom. The bottom erection plates 72*a*, 72*b*, 72*c* and 72*d* are similar to the top erection plates 70*a*, 70*b*, 70*c*, and 70*d* except that they are welded or bolted to the bottom of the frame 16 opposite the corresponding top erection plates 70*a*, 70*b*, 70*c* and 70*d* and each is provided with an alignment aperture 76 in place of the pin 74.

The off-set of each aperture 76 in each bottom erection plate 72*a–d* is determined by the type of column member by which the respective corner 16*a–d* will be supported when assembled in the platform 10, and the positioning of the respective pin in the capital erection plate which will be received in said aperture. For example, in a preferred embodiment, the pins 28 (corner), 34 (edge), and 40 (interior) are all positioned the same lateral distance from the vertical axis of the respective column as defined by the intersection of the web centerline and the flange centerline thereof. For enhanced support, it is desirable for the corner of the frame 16 to extend over as much of the horizontal surface of the column as possible. Thus, when corner 16*a* is supported on an edge column 24, the bottom erection plate 72*a* is of dimension similar to that of the capital erection plate 26 and the aperture 76 therein corresponds to the position of the projecting pin 28. However, when the corners 16*b* and 16*c* are supported on edge columns 30, for example, the bottom erection plates 72*b* and 72*c* would have a shape similar to the one-half portion of the capital erection plate 32 to one side of the flange centerline of the column 30, and the position of the aperture 76 would correspond to the position of the pin 34 so that one-half of the end surface area of the column 30 would be used for each adjacent frame member. Also in this preferred embodiment, the bottom erection plate 72*d*, for example, corresponds to being supported by the interior column 36 and has the shape and size to correspond to one quadrant section of the capital erection plate 38 so that its outer edges would correspond to the web and flange centerlines. The placement of the aperture 76 of the bottom erection plate 72*d* would also correspond to the position of the respective pin 40 on a capital erection plate 38. In this manner, the column 36 would have the corner 16*d* of the frame 16 resting on one-quarter of its upper surface area.

The top erection plates 70*a–d* have a correspondence to the basal erection plates of the columns of the next immediately higher tier or level.

In erecting the structure of the platform 10, a conventional foundation (not shown) is formed and a first level tier is installed with the corner columns 24 in each corner of the horizontal plan of the platform 10, the edge columns 30 along the outer edge of the horizontal plan of the platform 10 between each corner column 24, and an interior column 36, by means of a base 80 welded to each column and bolted or otherwise secured in a conventional manner in the appropriate position on the foundation. The columns 24, 30, and 36 may be prefabricated off-site and brought on location just prior to their installation.

The frames 16 may also be prefabricated off-site and brought onto location for their installation on the first tier of columns 24, 30 and 36. Each frame 16 is hoisted into position and mounted on its respective supporting columns using conventional hoisting techniques, e.g., with a crane. This may be facilitated by attaching the lugs 80 at each corner 16*a–d* of the frame 16 to permit the attachment of hoisting cables 86 so that the frame member 16 will be raised for mounting in a relatively horizontal attitude.

Figure 17:
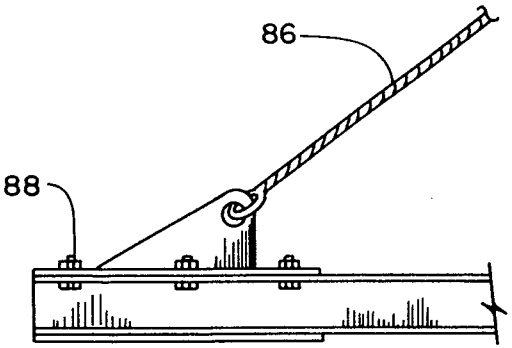
FIG. 17 is an elevation view of the lifting lugs illustrated in FIG. 16 according to the present invention.
Figure 16:
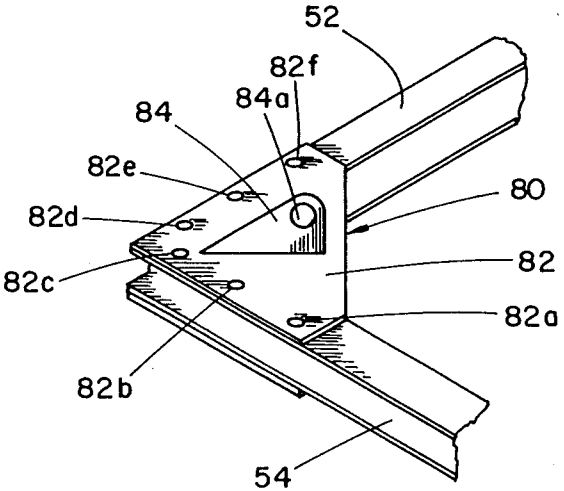
FIG. 16 is a perspective view of the lifting lugs according to the present invention.

As best seen in FIGS. 16 and 17, each lug 80 has a base plate 82 and a verticle flange 84. An aperture (not shown) may be formed in the base plate for receiving the upwardly projecting pin 74 from a respective top erection plate 70 of the frame 16, and suitable bolt holes 82 for bolting, or other means of connection thereto. The vertical flange 84 includes an aperture 84*a* for attachment of a hoisting cable 86 in a conventional manner.

The lugs 80 attached at each corner of the frame may be thus connected by a hoisting cable 86 attached to each lug 80, each hoisting cable 86 in turn connected to a central cable (not illustrated) suspended from the boom of a crane or other lifting device. When the frame 16 is properly positioned over the columns by which it is to be supported, it is lowered into place and each upwardly projecting pin on the capital erection plates 26, 32 and 38 of each column 24, 30 and 36 is received in the respective aperture 76 of the bottom erection plate 72 on each corner 16*a–d* of the frame 16, thereby positioning the frame 16 into proper alighment in the platform 10. The lugs 80 are then removed from each corner of the frame 16 and attached to the next frame for positioning in a similar manner. Once in position, the frame 16 is secured on its respective supporting columns by bolting together or otherwise securing each capital erection plate 26, 32 and 38 of the columns 24, 30 and 36 to each bottom erection plate 72 of the frame 16.

When the frames supported by the first tier of columns are in place, the second tier or story of columns may be similarly hoisted into place thereon using a crane column member so that the aperture in the basal plate receives the upwardly projecting pin from the top erection plate of the frame. The columns on the second tier are then bolted in place by bolting together the basal erection plates of the columns together or otherwise affixing the same to the top erection plate of the frame. The procedure is then repeated for each successive tier, level or story until the desired height of the platform or structure is obtained.

Figure 18:
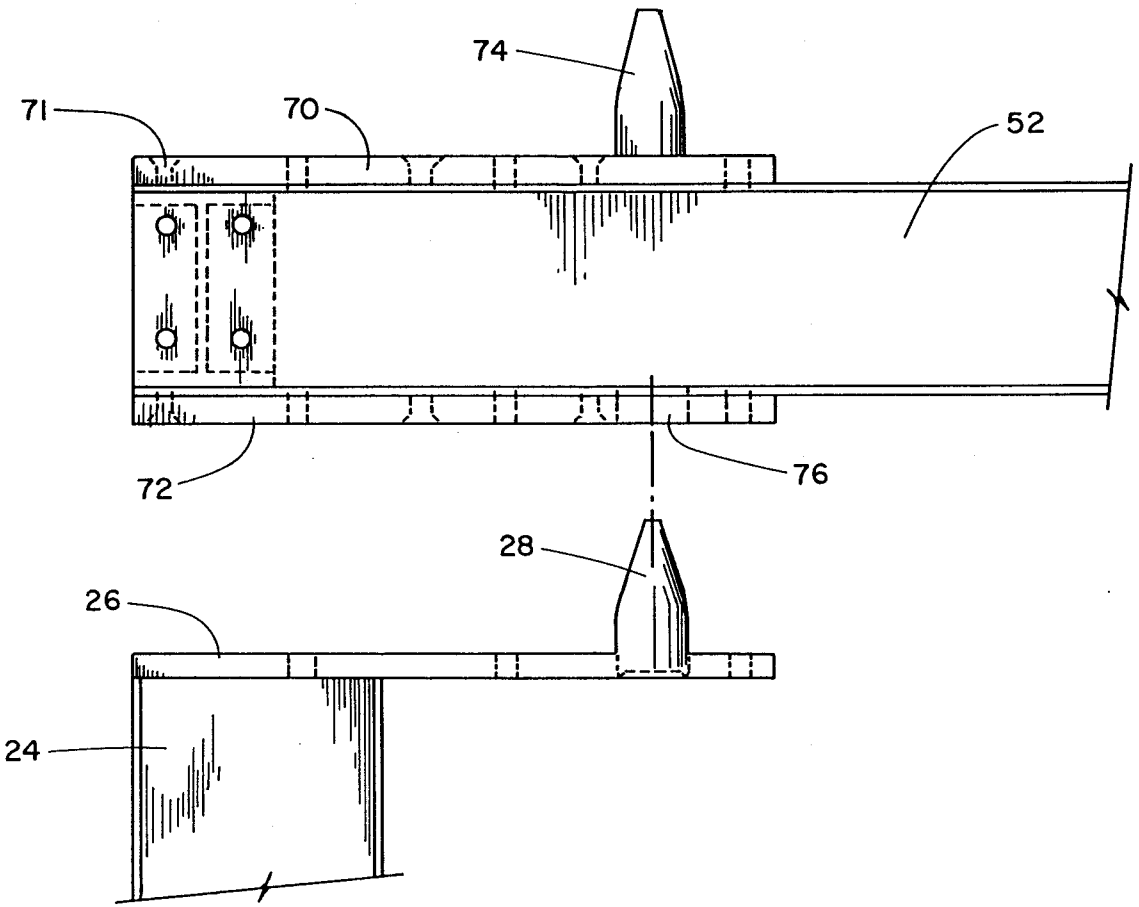
FIG. 18 is an elevation view of a corner column-erection plat per FIGS. 3 and 4 in conjunction with a corner column-frame member per FIGS. 13 and 14 according to the present invention.

As illustrated in FIG. 18, a corner 16*a* of a frame 16 is positioned for engagement with corner plate 26 resting the corner column 24. The corner plate 26 has welded thereto a pin 28 for registery with an alignment aperture 76 in the bottom erection plate 72 fixedly secured to the longitudinal side member 52. As the longitudinal side member 52 and bottom erection plate 72 are lowered onto the corner plate 26 and the corner column 24, the pin 28 with a fresto conical shape readily comes into registery with the alignment aperture. The corner plate 26 and the bottom erection plate 72 can be removeably secured utilizing the counter sunk bolt holes 71. Further, the top erection plate 70 and the associated pin 74 are now in position for engagement by another longitudinal side member 52 having a bottom erection plate 72 which can readily be brought into registery with its alignment aperture 76.

In this manner, the platform 10 is assembled and erected with a minimum number of personnel on the platform 10. Since a majority of the structural members are prefabricated and assembled off-site, the time spent in the structure by workers performing these functions is eliminated. It is only necessary to bolt each adjacent set of erection plates together as the platform is constructed.

Figure 15:
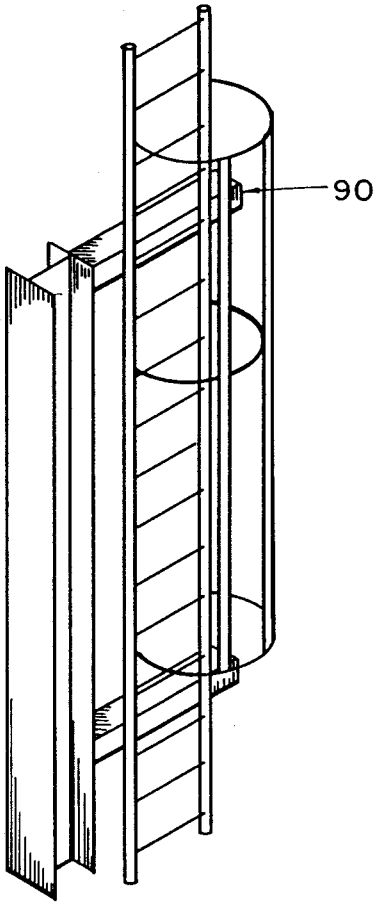
FIG. 15 is a perspective view of a caged ladder welded to a columnar member for use in the construction of FIG. 1 according to the present invention.

In addition, it is also possible to position other structural features of the platform 10 during the erection thereof. For example, as seen in FIG. 15, a column member may be provided with a caged ladder 90 or other fixture welded, bolted or otherwise affixed thereto. When the column member containing the attached fixture is put into place, the fixture is automatically simultaneously installed. By placing the second tier column with a similar fixture directly above the first tier column, a ladder, for example, is formed all the way up the structure for immediate access by personnel.

Figure 19:
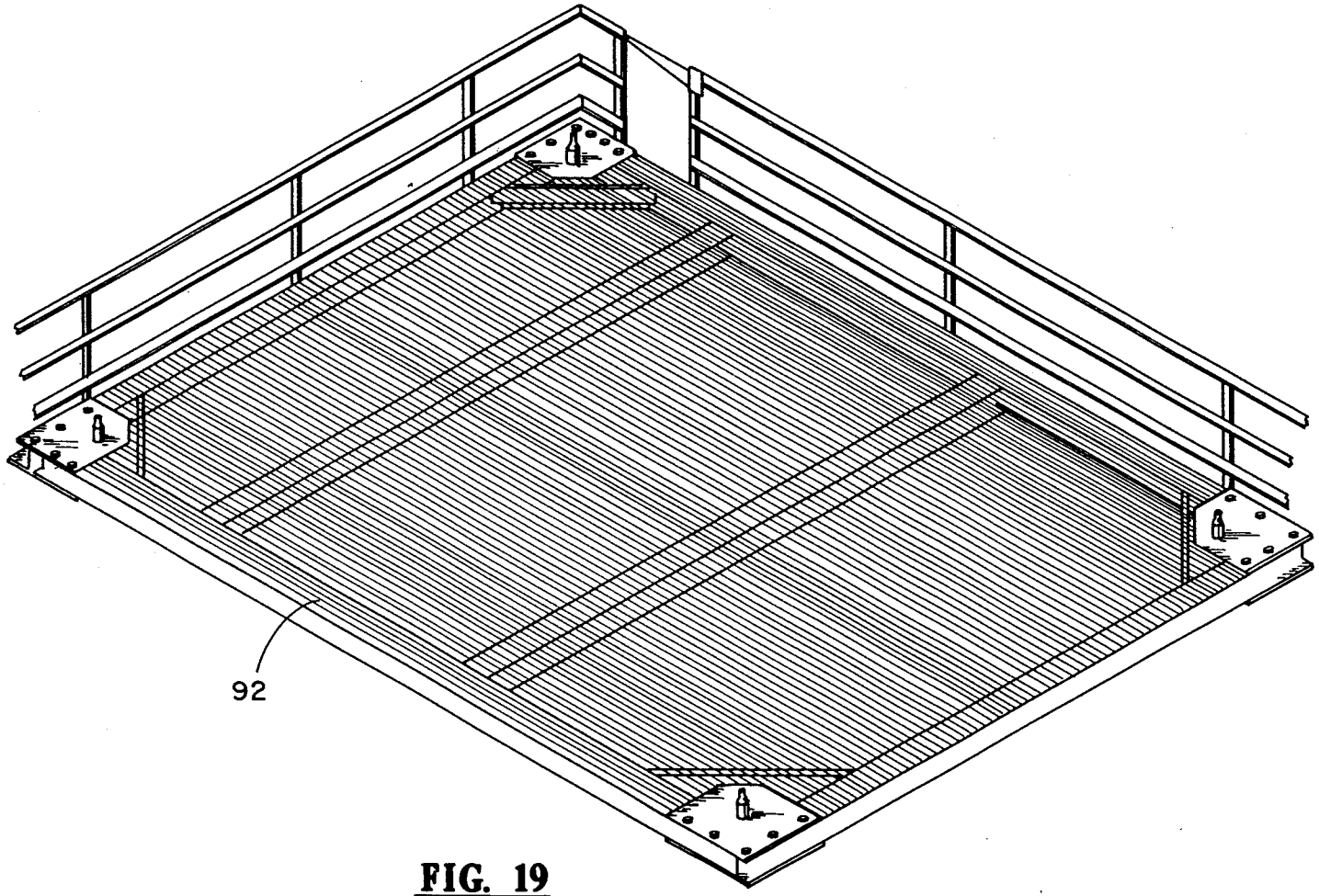
FIG. 19 is a perspective view of a prefabricated frame including a grating bolted into place prior to erection and a ladder opening and safety gate according to the present invention.

Also, it is possible to provide the frame 16 prefabricated with various safety features, equipment, and the like, such as, for example, grating 92 or flooring and railing as illustrated best in FIG. 19.

The foregoing description is illustrative and explanatory only, and various modifications thereto will occur to those skilled in the art in view thereof. It is intended that all such variations and modifications within the scope and spirit of the appended claims be embraced thereby.

What is claimed is:

1. A modular steel utility structure, comprising: a plurality of vertical steel columns, each column having capital and basal steel erection plates fixedly secured at respective upper and lower ends thereof, said capital plate having at least one alignment pin extending upwardly therefrom and laterally spaced from said column, said basal plate having at least one vertical alignment aperture spaced laterally from said column; at least one horizontal steel frame, each frame comprising horizontal steel beams and a plurality of top and bottom erection plates fixedly secured on said beams, said bottom erection plate having an alignment aperture spaced from said beams for receiving in registration the pin from a capital plate of a column immediately therebeneath, said top erection plate having an upwardly projecting alignment pin which is received in registry by the aperture in a basal plate of a column immediately thereabove.

2. The structure of claim 1, wherein each of said pins has a relatively large transverse dimension adjacent the erection plate from which it projects and a relatively small transverse dimension away from said plate for being received in said apertures.

3. The structure of claim 1, further comprising a plurality of first level steel columns, each having a base secured to a foundation and a capital erection plate having at least one pin extending upwardly into the aperture of one of said bottom erection plates of said frame.

4. The structure of claim 1, wherein said columns include corner columns having capital erection plates with one pin for supporting a said frame at an outside corner thereof.

5. The structure of claim 1, wherein said columns include edge columns each having a capital erection plate with a pair of pins on opposite sides of the column for supporting a pair of adjacent frames, at opposing adjacent corners thereof, each frame having an aperture in a bottom erection plate receiving each respective pin.

6. The structure of claim 1, wherein said columns include interior columns, each having a capital erection plate with a multiplicity of pins positioned circumferentially around said column for supporting a like number of adjacent frames.

7. The structure of claim 1, wherein said frames are rectangular.

8. The structure of claim 1, wherein the structure comprises a plurality of stories comprising vertically alternating sets of said columns and said frames.

9. The structure of claim 1, wherein said basal and capital columnar erection plates are secured to an adjacent frame.

10. A method of modularly assembling a steel utility structure, comprising the steps of:

(a) mounting a plurality of prefabricated horizontally spaced lower level steel columns, each column having a capital erection plate with an upwardly projecting pin laterally spaced from the respective column, wherein said capital erection plates are at uniform elevation and a lower end of each column is fixedly supported;

(b) mounting at least one upper level steel frame with corners supported by said lower level columns, said frames being prefabricated and having top and bottom erection plates at each supported corner, each said bottom erection plate having an aperture for receiving said respective capital erection plate pin, each said top erection plate secured opposite said bottom plate and having an upwardly projecting pin laterally spaced from the respective lower level column;

(c) mounting a plurality of prefabricated steel upper level columns on said top erection plates of said upper level frames, said upper level columns each having a basal and a capital steel erection plate at opposite ends thereof, said basal erection plate having an aperture spaced from said column for receiving a respective upper level frame top erection plate pin, said capital plate having an upwardly projecting pin laterally spaced from the column, wherein said capital plates are at uniform elevation;

(d) repeating steps (b) and (c), wherein each upper level of columns in the preceding step (c) becomes the lower level columns in the subsequent step (b), until a plurality of levels are obtained; and (e) mounting a terminal level of one or more steel frames with corners supported by said upper level columns, said frames being prefabricated and having bottom erection plates at each supported corner with an aperture formed therein for receiving the capital erection plate pin of said upper level columns.

11. The method of claim 10, wherein said apertures are frustoconical with a relatively larger transverse dimension at a lower end thereof and a relatively small diameter at an upper end thereof.

12. The method of claim 10, wherein said pins have a relatively large transverse dimension adjacent the erection plate from which its projects and a relatively small transverse dimension away from said plate for being received in said apertures.

13. The method of claim 10, wherein each level of columns includes corner columns having capital erection plates with one pin for supporting a said frame at an outside corner thereof.

14. The structure of claim 10, wherein each level of columns include edge columns each having a capital erection plate with a pair of pins on opposite sides of the column for supporting a pair of adjacent frames, at opposing adjacent corners thereof, each frame having an aperture in a bottom erection plate receiving each respective pin.

15. The structure of claim 10, wherein said columns include interior columns, each having a capital erection plate with a multiplicity of pins positioned circumferentially around said column for supporting a like number of adjacent frames.

16. The method of claim 10, wherein said frames are rectangular.

17. The method of claim 10, further comprising the steps of bolting each said capital erection plate to an adjacent bottom erection plate and each basal erection plate to an adjacent top erection plate.

18. The method of claim 10, wherein said frame mounting step (b) comprises attaching to said frame a plurality of lugs adapted for attachment to a hoisting cable, said lugs being adapted for attachment at a said top erection plate; using hoisting cables attached to said lugs to maneuver said frames into position for said mounting; and removing said lugs from said top erection plates.

19. The method of claim 10, wherein a ladder is attached to at least one of said columns.

* * * * *